United States Patent [19]

Eggers

[11] Patent Number: 4,830,676

[45] Date of Patent: May 16, 1989

[54] APPARATUS AND PROCESS FOR TREATING THE SURFACES OF TUBULAR MEMBERS WITH LIQUIDS

[75] Inventor: Detlev Eggers, Neuanspach, Fed. Rep. of Germany

[73] Assignee: Metallgesellschaft Aktiengesellschaft, Frankfurt am Main, Fed. Rep. of Germany

[21] Appl. No.: 91,634

[22] Filed: Sep. 1, 1987

[30] Foreign Application Priority Data

Sep. 3, 1986 [DE] Fed. Rep. of Germany ..... 3629972
Jul. 24, 1987 [DE] Fed. Rep. of Germany ..... 3724505

[51] Int. Cl.[4] ..... B08B 9/04

[52] U.S. Cl. ..... 134/22.18; 134/22.16; 134/24; 134/62; 134/64 R; 134/67; 134/83; 134/167 R; 134/169 R; 134/184; 15/39.2

[58] Field of Search ..... 134/24, 10, 22.18, 21, 134/16, 167 R, 169 R, 184, 83, 62, 64 R, 67, 22.1; 15/392

[56] References Cited

U.S. PATENT DOCUMENTS 3,156,248 11/1964 Rand ..... 134/83
4,057,070 11/1977 van Amerongen et al. ..... 134/83
4,392,506 7/1983 Tanaka et al. ..... 134/46
4,705,575 11/1987 Koch ..... 134/24

FOREIGN PATENT DOCUMENTS 227820 7/1969 U.S.S.R. ..... 134/83

*Primary Examiner*—Asok Pal
*Attorney, Agent, or Firm*—Sprung Horn Kramer & Woods

[57] ABSTRACT

A treating tank which contains a bath of the liquid and a movable support for the tubular members in the bath. An infeeding device having a three-dimensionally sloping chute is disposed on one side of the treating tank above the bath and causes one end of the tubular members to lead as the tubular members enter the bath. A gratelike support is disposed in the treating tank and has a top surface, which slopes down from that side of the treating tank which is provided with the infeeding device to the other side. The gratelike support is provided at either end with a separate, controllable lifting and lowering device. An outfeeding device having a three-dimensionally sloping chute is provided above the bath on the other side of the treating tank.

8 Claims, 4 Drawing Sheets

APPARATUS AND PROCESS FOR TREATING THE SURFACES OF TUBULAR MEMBERS WITH LIQUIDS

BACKGROUND OF THE INVENTION

This invention relates to an apparatus for treating the surfaces of tubular members with liquids consisting of a treating tank which contains a bath of the liquid and a movable support for the tubular members in the bath.

The surfaces of metallic tubular members are treated by being pickled in pickling tanks. For that purpose the tubular members must be introduced into the pickling tanks and moved in the pickle and be removed and are subsequently rinsed in rinsing tanks.

The tubular members are introduced into the tanks in the form of packs, which are inserted into chains or U-shaped holders. A crane is used to move the packs into the tanks an to move them in the tanks and to remove them from the tanks (Otto Vogel, "Handbuch der Metallbeizerei", Verlag Chemie GmbH, Weinheim/-Bergstrasse, 1951, pages 342–347). In that process the chains or U-shaped holders enter the bath, the tubular members contract each other also as they are moved in the bath, and it is virtually impossible to encapsulate the baths to permit vapors to be exhausted.

German Patent Publication No. 16 21 624 discloses a cylindrical tank, which is its bottom contains rams, which are vertically reciprocated so that tubular members which loosely lie in the tank in the form of a bundle are moved relative to each other. The leadthroughs in which the rams extend through the bottom must be sealed, and the tubular members must be moved by hand into and out of the tank.

Published German Application No. 15 46 155 discloses a rack, in which raillike supports for respective tubular members are arranged in superimposed tiers. When the rack is reciprocated in the tank, the tubular members roll on the raillike supports. The tubular members must be placed on the supports by hand. The rack is immersed into the tank, and it is virtually impossible to encapsulate the tank.

SUMMARY OF THE INVENTION

It is an object of the invention to avoid the disadvantages of the known processes and to permit a uniform treatment of the surfaces of tubular members without a need for a manual introduction and removal of the tubular members, and also to permit an effective encapsulation of and exhausting from the tanks.

That object is accomplished in accordance with the invention in that an infeeding device having a three-dimensionally sloping chute is disposed on one side of the treating tank above the bath and causes one end of the tubular members to lead as the tubular members enter the bath, a gratelike support is disposed in the treating tank and has a top surface, which slopes down from that side of the treating tank which is provided with the infeeding device to the other side, the gratelike support is provided at either end with a separate, controllable lifting and lowering device and an outfeeding device having a three-dimensionally sloping chute is provided above the bath on the other side of the treating tank. The support consists of a box-shaped frame. The top surface for supporting the tubular members is preferably zig-zag shaped. The treating tank and the top surface of the support are provided with cleats of wood or plastic so that a direct contact of the tubular members with the material of the grate, which material consists of stainless steel or plastic, will be avoided. The support can be secured to the lifting and lowering device by means of only two hinges, which are only slightly movable and are immersed into the bath. Alternatively, the connection may be established by tie plates, which are rigidly fixed by welding and take up the movement by being elastically deformed like a leaf spring so that there is no hinge which is immersed into the bath.

In accordance with a further preferred feature, the first treating tank consists of a pickling tank, a support for movably supporting the tubular members is disposed in front of the sloping chute of the infeeding device, vertical posts are disposed in the bath and distributed over the length of the gratelike support and partly extend through the top surface of the support when it is lowered, said posts have a top face which slopes oppositely to the top surface of the support and during a vertical movement of the support in a vertical direction cause the tubular members to roll, the outfeeding device extends from the treating tank and opens into an infeeding device of a second treating tank, which constitutes a rinsing tank, and the first treating tank with its infeeding device and outfeeding device is encapsulated. The rinsing tank may be provided with vertical posts, which extend through the top surface of the support.

In accordance with a further preferred feature, the outfeeding device of the pickling tank extends into the rinsing liquid in the infeeding device of the rinsing tank. That design permits the pickling tank to be completely encapsulated in a simple manner.

In accordance with a further preferred feature, a plurality of rinsing tanks are connected in series, the outfeeding devices and infeeding devices of adjacent rinsing tanks are structurally combined, and the outfeeding device of the last rinsing tank opens into a receiving device. This permits an effective rinsing to be achieved in a simple manner.

In accordance with a further preferred feature, the outfeeding devices are provided with shutter flaps and actuating means for opening and closing the shutter flaps. The actuating means may consist of a common actuator for all flaps or of individual actuators for respective flaps. As a result, when the flaps are closed the tubular members can be moved on the gratelike supports exactly to the delivery position in front of the three-dimensionally sloping chutes and the flaps can then be opened so that the tubular members run down the chutes. Particularly in the treatment of thin tubular members that practice will avoid a bending and interlacing of the tubular members and the tubular members will be optimally immersed.

In accordance with a further preferred feature, the actuating means for opening and closing the shutter flaps consists of fulcrums, hinges, a linkage, which connects the fulcrums, hinges and flaps, and actuating means, which are connected to the linkage at one fulcrum.

In a preferred method of operating the apparatus, the gratelike support and the tubular member lying thereon are raised out of the bath to assume a sloping position in that one of the lifting and lowering devices is operated with a lead, and by follow-up movement of the other lifting and lowering device are moved to a position in front of the outfeeding device having a three-dimensionally sloping chute.

In a preferred method of operating the apparatus the shutter flaps are opened after the gratelike supports have reached their deliverying position in front of the three-dimensionally sloping chutes and are closed when the tubular members have been delivered to the following treating tanks.

The invention will be explained more in detail with reference to the drawings, wherein:

DETAILED DESCRIPTION OF THE INVENTION

Figure 1:
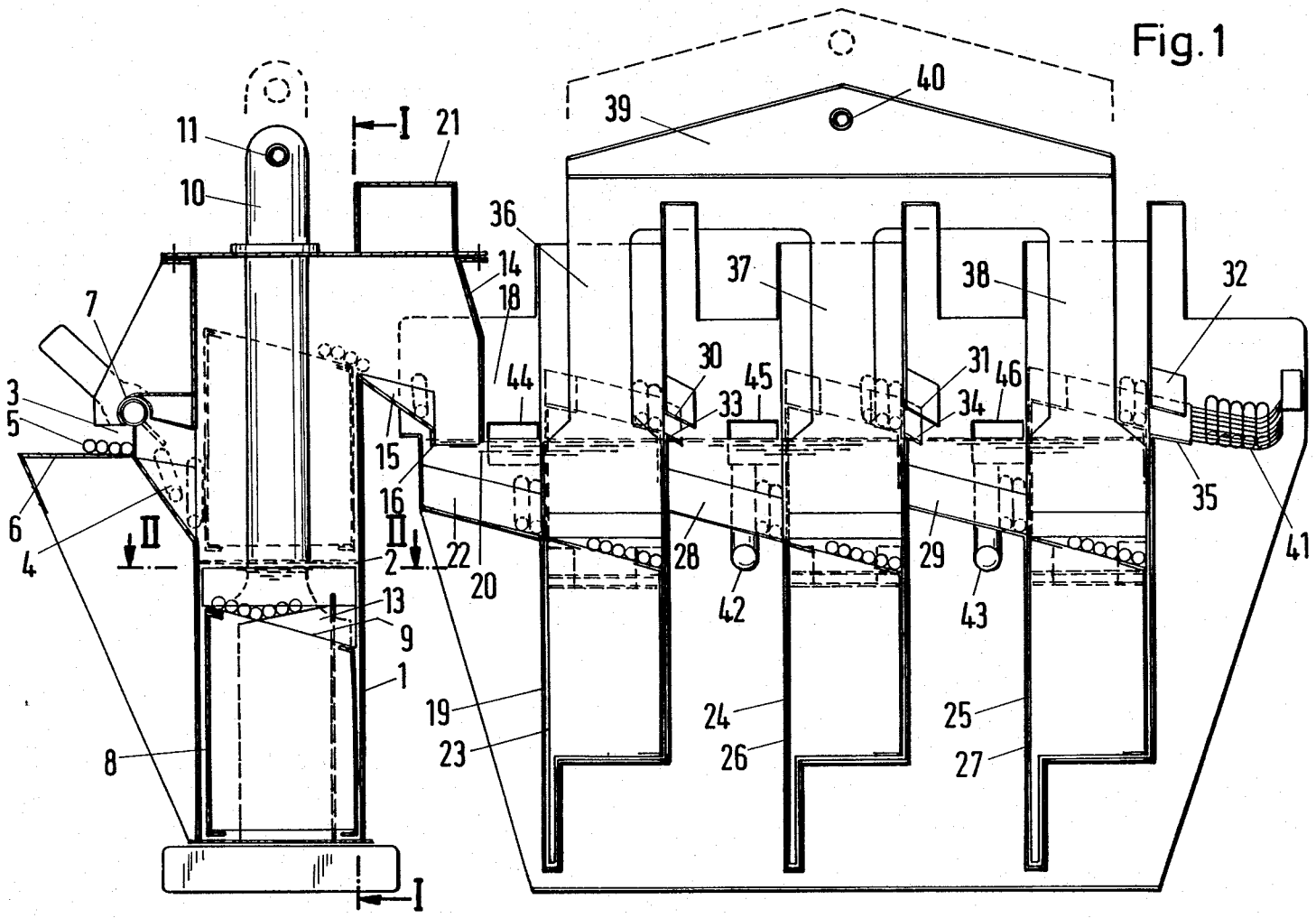
FIG. 1 shows a first treating tank, in which the tubular members are pickled, and three succeeding treating tanks, in which the pickled tubular members are washed according to the invention.
Figure 2:
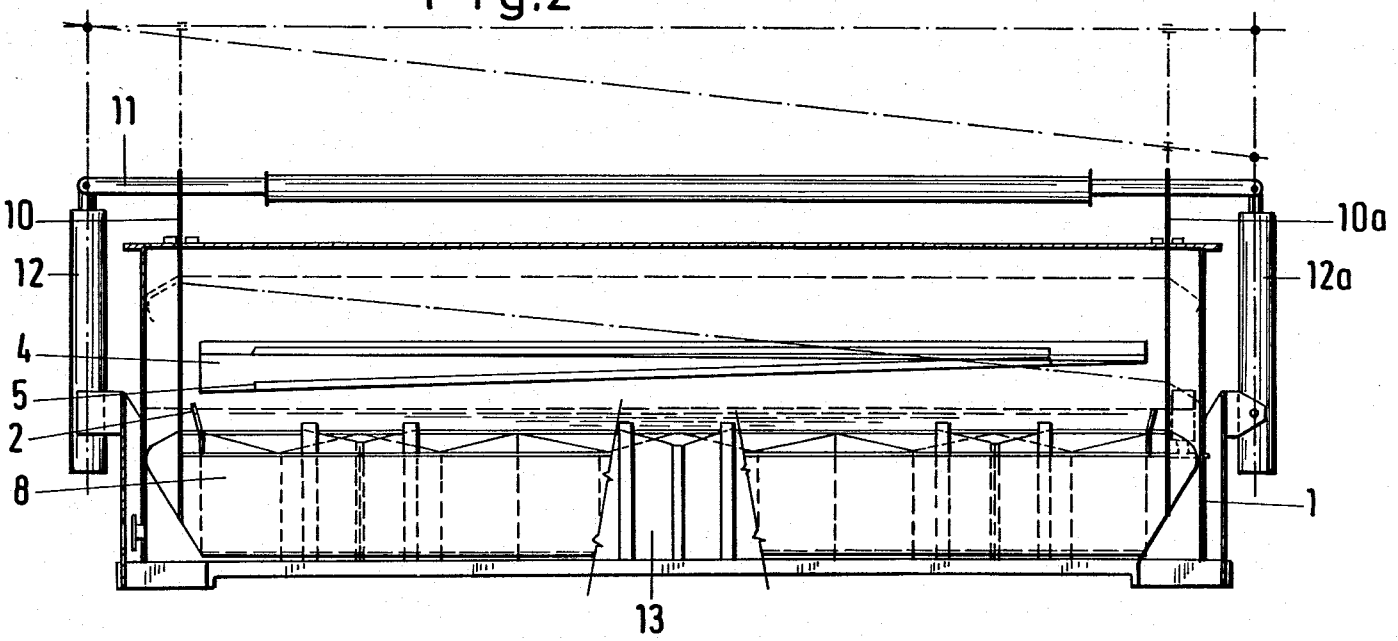
FIG. 2 is a sectional view taken on line I—I in FIG. 1 with the gratelike support structure cut open in the middle so that a vertical post is visible.
Figure 3:
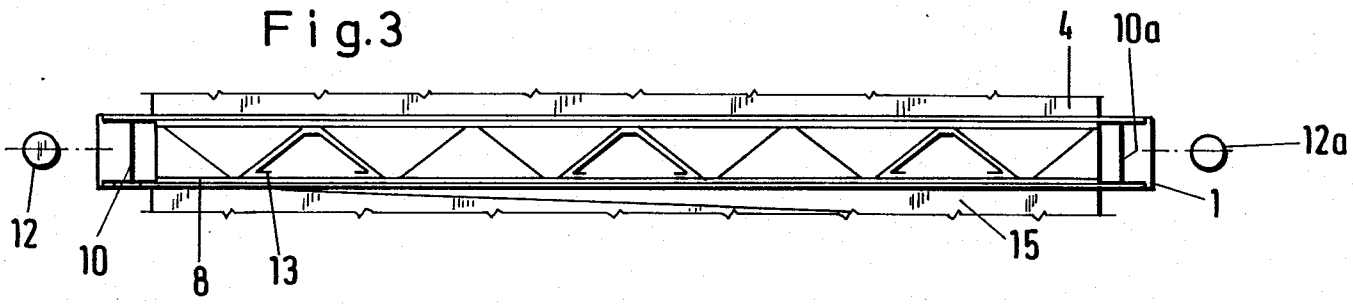
FIG. 3 is a sectional view taken on line II—II in FIG. 1.
Figure 5B:
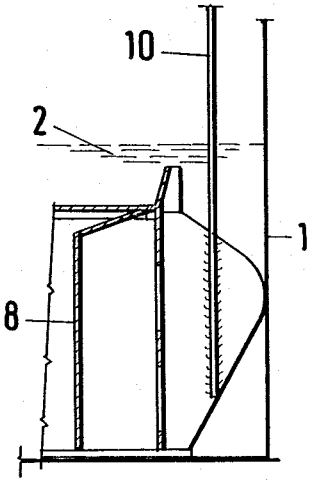
FIG. 5*b* shows the right-hand end of the gratelike support of FIG. 2 on a larger scale with a tie rod which has been fixed by welding and acts like a spring.
Figure 5A:
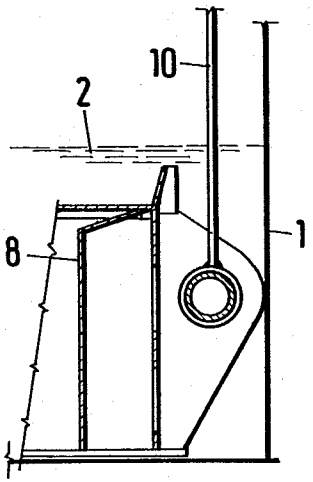
FIG. 5*a* shows the right-hand end of the gratelike support of FIG. 2 on a larger scale with a hinge.
Figure 4B:
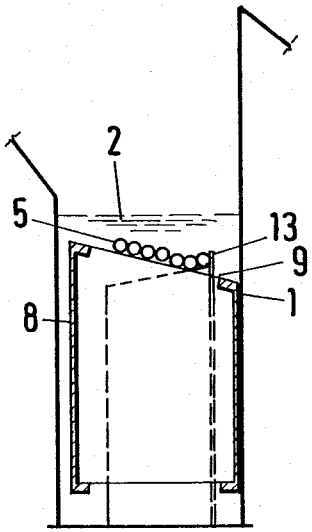
FIG. 4*b* shows the gratelike support of FIG. 1 and illustrates the movement of the supported tubular members in a slightly raised position.
Figure 4A:
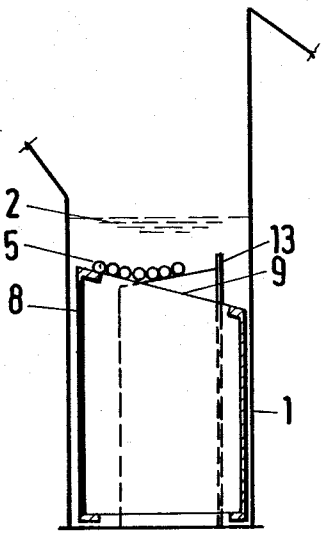
FIG. 4*a* shows the gratelike support of FIG. 1 and the tubular members lying thereon in the lowermost position.

Referring to FIGS. 1–5, an infeeding device 3 is disposed on one longitudinal side of a treating tank 1 above a bath 2 and comprises a three-dimensionally sloping chute 4. Tubular members 5 lie on a feed deck 6 and when flap 7 is opened, roll onto the chute 4 in such a manner that one end of each tubular member leads so that it is the first end to enter the pickling bath 2 and the air in the tubular members is forced out at the other end. The treating tank 1 contains a gratelike support 8, which has a top surface 9 that slopes from that side of the treating tank 1 where the infeeding device 3 is provided toward the other side. The gratelike support 8 is connected at both ends by tie rods 10, 10*a* and a crosstie 11 to lifting and lowering devices 12, 12*a*, which are separately controllable. A plurality of fixed posts 13 are disposed in the treating tank 1 and partly extend through the top surface of the support 8 when the latter is in its lower position indicated by solid lines. The top faces o the posts 13 slope oppositely to the top surface 9 of the support 8 so that the tubular members 5 lie in the bath 2 in a V-shaped trough. When the support 8 is slightly raised and lowered by means of the lifting and lowering means 12, 12*a*, the leg lengths of the V-shaped trough are changed and the tubular members are reciprocated. The movements imparted to the support 8 by means of the two lifting and lowering devices 12, 12*a* may be equal or unequal or opposite to each other so that uniform, swinging or rocking movements may be imparted to the tubular members. An outfeeding device 14 is provided in the longitudinal side of the treating tank 1 in its upper portion above the bath 2 and consists of a slot in the side wall, a three-dimensionally sloping chute 15 and a shaft 16, which is immersed in bath 20 of infeeding device 18 of second treating tank 19 so that an air seal is provided. The second treating tank 19 constitutes a rinsing tank and contains a water bath. The treating tank 1 is completely encapsulated and is provided with an exhaust 21. When the pickling time has expired, the support 8 is raised to a sloping position, indicated in phantom, in that one lifting and lowering device 12, 12*a* is moved with a lead. After an adjustable time, when the tubular members have been entirely drained, the second lifting and lowering device 12, 12*a* performs a follow-up movement to assume the position shown in dotted lines, so that the tubular members 5 roll from the support 8 through the slot in the side wall to the sloping chute 15 and drop through the shaft 16 into the bath 20 onto the sloping receiving surface 22 of the infeeding device 18 in such a manner that the tubular members enter the washing water with one end ahead and air and residual pickle will be rinsed out of the tubular members at their other end. The support 8 is then moved to its lowermost position and the next charge can be fed into the tank 1. The tubular members 2 on the receiving surface 22 remain in position in front of the support 23, which has been raised to the position indicated by dotted lines, and when the support 23 has been lowered roll onto its top surface.

The washing stage comprises three treating tanks 19, 24 and 25, which are provided with supports 23, 26 and 27, receiving surfaces 22, 28 and 29 and outfeeding devices 30, 31 and 32. The latter consists also of sloping slots in the side walls of the treating tanks 19, 24 and 25 and of three-dimensionally sloping chutes 33, 34 and 35. The supports 23, 26 add 27 are secured by means of tie rods 36, 37 and 38 and a common yoke 39 to two crossties 40, which are secured to two lifting and lowering devices, which are separately controllable and are of the type shown in FIG. 1. Washing is performed analogously to pickling. When the washing time has expired, the supports 23, 26 and 27 are raised, just as in the pickling stage, in that one lifting and lowering device is moved with a lead. By a follow-up movement of the second lifting and lowering device and a simultaneous lowering of the first lifting and lowering device by a small distance the supports 23, 26 and 27 are moved to such a position in front of the slightly sloping slots in the longitudinal walls that those ends of the tubular members from which said members can be drained are the least to enter the washing water in the next following treating tank so that the tubular members will be rinsed through in the direction in which they are drained. The last outfeeding device 32 is succeeded by a rounded, stationary receiving grate 41, from which the tubular members can be taken by a crane. The pipelines 43 and 44 conduct the washing water from the overflows 46 and 45 of the tanks 25 and 24 into the tanks 24 and 19 so that the washing water in the rinsing tanks flows in a direction which is opposite to the movement of the tubular members being treated and is withdrawn at the overflow 44 of the tank 19. The tank 25 is supplied with fully deionized water. The tank 24 may additionally be supported with normal water.

The pipeline 43 contains a conductivity sensor so that an optimum consumption of deionized water can be adjusted.

Figure 6:
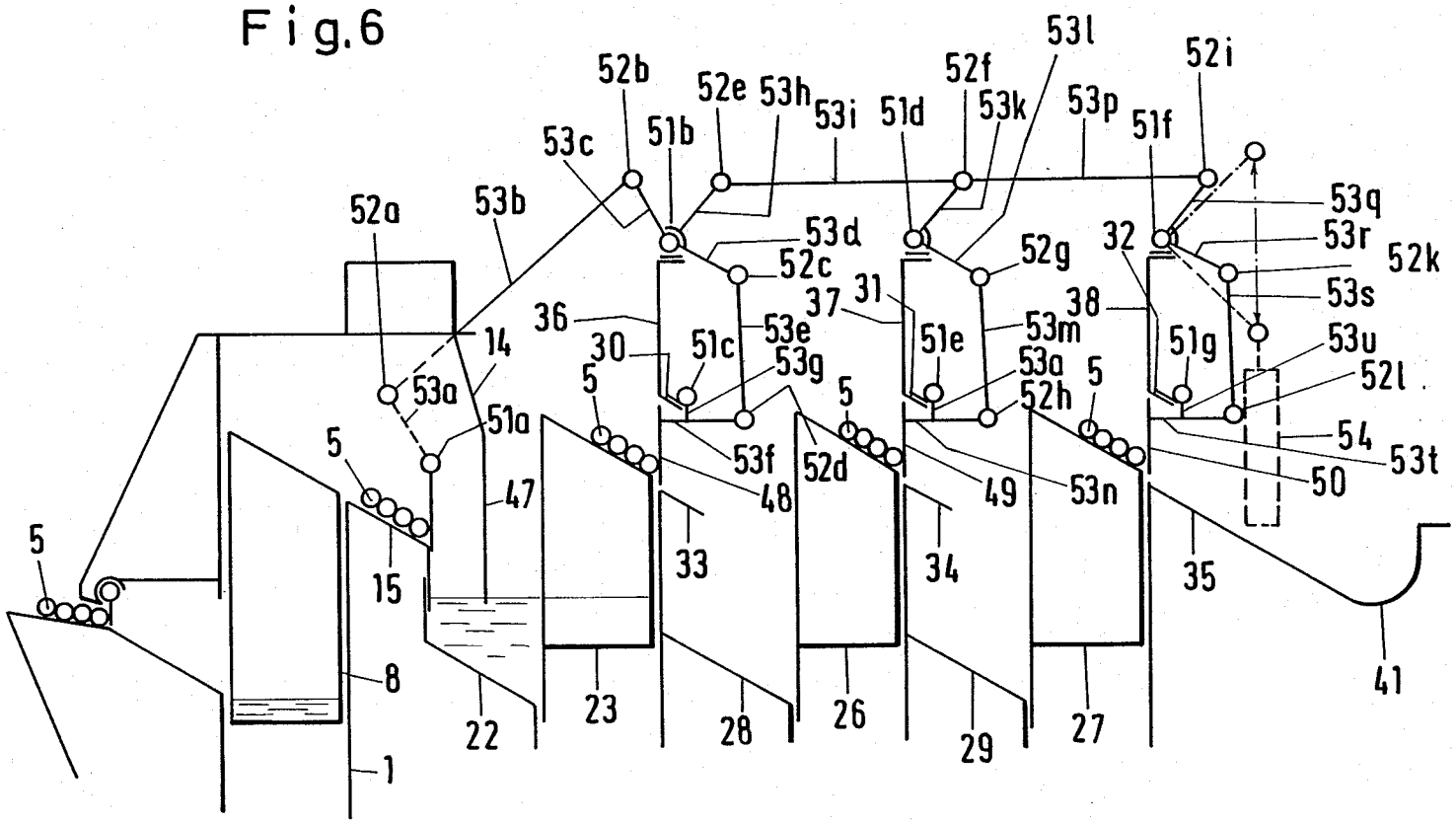
FIG. 6 shows the gratelike supports with the tubular members in delivery position in front of the three-dimensionally sloping chutes and closed shutter flaps and their actuating means.

In accordance with FIG. 6, the outfeeding devices 14, 30, 31, 32 contain shutter flaps 47, 48, 49, 50, which are shown in a closed position. The shutter flap 47 is connected to the fulcrum 51*b* by means of the fulcrum 51*a*, rod 53*a*, hinge 52*a*, rod 53*b*, hinge 52*b* and rod 53*c*. The shutter flap 48 is also connected to the fulcrum 51*b* by rods 53*f* and 53*g* provided with the fulcrum 51*c* and by the hinge 52*d* and the rod 53*e*, the hinge 52*c* and the rod 53*d*. The fulcrum 51*b* is connected to the fulcrum 51*f* by the rod 53*h*, the hinge 52*e*, the rod 53*i*, the hinge 52*f*, the rod 53*p*, the hinge 52*i* and the rod 53*q*. The shutter flap 49 is connected to the hinge 52*f* by the rods 52*o* and 53*n* having the fulcrum 51*e* and by the hinge 52*h* the rod 53*m*, the hinge 52*g*, the rod 53*l*, the fulcrum 51*d* and the rod 53*k*. The shutter flap 50 is connected to the fulcrum 51*f* by rods 53*u* and 53*t* provided with the fulcrum 51*g* and the hinge 52*l* and by the rod 53*a*, the hinge 53*k* and the rod 53*r*. The actuator 54 is connected to the linkage at the fulcrum 51*f*. When the actuator 54 is moved to its upper position, all shutter flaps 47, 48, 49 and 50 are opened and the tubular members 5 roll into the respective succeeding treating tanks.

The advantages afforded by the invention reside in that the tubular members are introduced into the treating tanks automatically and without a need for auxiliary equipment and that the tubular members are treated exactly and uniformly and a complete encapsulation and satisfactory exhausting can be achieved.

What is claimed is:

1. An apparatus for treating the surfaces of tubular members with liquids, comprising: a totally encapsulated first treating tank which contains a bath of a liquid and a movable support for tubular members in the bath, first infeeding means having a three-dimensionally sloping chute and disposed on one side of the treating tank above the bath and for causing one end of each tubular member to lead as the tubular member enters the bath, a gratelike support disposed in the treating tank and having a top surface which slopes down from said one side of the treating tank to an opposite side, wherein the gratelike support has a separate, controllable lifting and lowering device at ends thereof, first outfeeding means having a three-dimensionally slopping chute and disposed above the bath at said opposite side of the first treating tank.

2. The apparatus according to claim 1, wherein the first treating tank comprises a pickling tank, a support for movably supporting the tubular members and disposed in front of the sloping chute of the first infeeding means, vertical posts disposed in the bath and distributed over the length of the gratelike support and partly extending through the top surface of the support when the support is lowered, said posts having a top face which slopes oppositely to the top surface of the support and to cause the tubular members to roll during a vertical movement of the support in a vertical direction, wherein the first outfeeding means extends from the treating tank and opens into second infeeding means of a second treating tank which constitutes a rinsing tank, whereby the first treating tank, the first infeeding means and the first outfeeding device are encapsulated.

3. The apparatus according to claim 2, wherein the first outfeeding means of the pickling tank extends into the rinsing liquid in the second infeeding means of the rinsing tank.

4. The apparatus according to claim 1, comprising a plurality of rinsing tanks connected in series, wherein each tank has outfeeding means and infeeding means and wherein the outfeeding means and infeeding means of adjacent rinsing tanks are structurally combined, and the outfeeding means of the last rinsing tank opens into a receiving device.

5. The apparatus according to claim 4, wherein the outfeeding means have shutter flaps and actuating means for opening and closing the shutter flaps.

6. The apparatus according to claim 5, wherein the actuating means for opening and closing the shutter flaps comprises fulcrums, hinges, a linkage which connects the fulcrums, hinges and flaps, and an actuator connected to the linkage at one fulcrum.

7. A method of treating the surfaces of tubular members with liquids, comprising: providing a totally encapsulated treatment tank with a bath of liquid, infeeding the tubular members into the bath at one side with one end leading by a three dimensional sloping chute, providing a gratelike support in the tank with a top surface providing a lifting and lowering device for the support, and outfeeding the members from an opposite side of the tank by a three dimensionally sloping chute above the bath, and raising the gratelike support and the tubular members lying thereon out of the bath to assume a sloping position by operating one of the lifting and lowering devices with a lead, and by a follow-up movement of the other lifting and lowering device to a position in front of the outfeeding means with the three-dimensionally sloping chute.

8. A method of treating the surfaces of tubular members with liquids, comprising: providing a plurality of treatment tanks in series each with a bath of liquid, each with a three-dimensional sloping chute infeed for causing one end of the members to lead into the bath and a three dimensional sloping chute outfeed on opposite sides of the tanks structurally combining the infeed and outfeed of adjacent tanks, controlling flow of the outfeeds with shutter flaps, providing a gratelike support with a top surface in each tank, providing a lifting and lowering device for each support, and raising the gratelike support and the tubular members lying thereon out of the bath to assume a sloping position by operating one of the lifting and lowering devices with a lead, and by a follow-up movement of the other lifting and lowering device to a position in front of the outfeeding means with the three-dimensionally sloping chute and opening the shutter flaps after raising the gratelike supports and closing the flaps with the tubular members have been delivered to the following treating tanks.

* * * * *

UNITED STATES PATENT AND TRADEMARK OFFICE

CERTIFICATE OF CORRECTION

PATENT NO. : 4,830,676

DATED : May 16, 1989

INVENTOR(S) : Detlev Eggers

It is certified that error appears in the above-identified patent and that said Letters Patent is hereby corrected as shown below:

Col. 6, claim 8 Delete " with " and substitute -- when --
line 56

Signed and Sealed this

Twenty-eighth Day of April, 1992

*Attest:*

HARRY F. MANBECK, JR.

*Attesting Officer*

*Commissioner of Patents and Trademarks*